US009355803B2

(12) United States Patent
Schuster et al.

(10) Patent No.: US 9,355,803 B2
(45) Date of Patent: May 31, 2016

(54) ACTUATOR WITH THERMOMAGNETIC SHUNT, ESPECIALLY FOR TRIGGERING A CIRCUIT BREAKER

(71) Applicant: SCHNEIDER ELECTRIC INDUSTRIES SAS, Rueil-Malmaison (FR)

(72) Inventors: Philippe Schuster, Grenoble (FR); Nathalie Caillault, Vourey (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/647,363

(22) PCT Filed: Nov. 25, 2013

(86) PCT No.: PCT/FR2013/052836

§ 371 (c)(1),
(2) Date: May 26, 2015

(87) PCT Pub. No.: WO2014/087073

PCT Pub. Date: Jun. 12, 2014

(65) Prior Publication Data

US 2015/0318135 A1 Nov. 5, 2015

(30) Foreign Application Priority Data

Dec. 3, 2012 (FR) ..... 12 61532

(51) Int. Cl.

| | |
|---|---|
| ***H01H 37/00*** | (2006.01) |
| ***H01H 71/14*** | (2006.01) |
| ***H01H 71/24*** | (2006.01) |
| ***H01H 50/16*** | (2006.01) |
| ***H01F 7/08*** | (2006.01) |
| ***H01F 7/16*** | (2006.01) |

(52) U.S. Cl.

CPC ..... *H01H 71/142* (2013.01); *H01F 7/081* (2013.01); *H01F 7/1607* (2013.01); *H01F 7/1638* (2013.01); *H01H 50/16* (2013.01); *H01H 71/2454* (2013.01); *H01H 71/2463* (2013.01)

(58) Field of Classification Search

CPC ..... H01H 37/58; H01H 71/142
USPC ..... 335/23, 208, 217, 218
See application file for complete search history.

(56) References Cited

U.S. PATENT DOCUMENTS

| | | | |
|---|---|---|---|
| 2,690,528 | A | 9/1954 | Wilckens |
| 6,154,115 | A | 11/2000 | Flohr |
| 2005/0046533 | A1 | 3/2005 | Chell |

FOREIGN PATENT DOCUMENTS

DE 20 2012 000 111 U1 7/2012

(Continued)

OTHER PUBLICATIONS

International Search Report issued Apr. 16, 2014 in corresponding PCT/FR2013/052836.

*Primary Examiner* — Ramon M Barrera
(74) *Attorney, Agent, or Firm* — Oblon, McClelland, Maier & Neustadt, L.L.P.

(57) ABSTRACT

An electromagnetic actuator including a saturable magnetic shunt system. The shunt is associated with a coil of the actuator and allows channeling of a more or less large part of the flow according to current circulating in the product. In this way, when the actuator is used in a circuit breaker, the actuator allows the circuit breaker to be triggered from a short circuit as usual and also from overload caused by action of the shunt.

9 Claims, 3 Drawing Sheets

(56) References Cited

FOREIGN PATENT DOCUMENTS

| | | | |
|---|---|---|---|
| EP | 0 537 090 | B1 | 12/1995 |
| EP | 1 001 444 | A2 | 5/2000 |
| EP | 0 926 693 | B1 | 3/2006 |
| EP | 1 792 326 | B1 | 7/2009 |
| FR | 2 682 533 | A1 | 4/1993 |
| FR | 2 772 981 | A1 | 6/1999 |
| WO | WO 2006/032649 | A1 | 3/2006 |

ACTUATOR WITH THERMOMAGNETIC SHUNT, ESPECIALLY FOR TRIGGERING A CIRCUIT BREAKER

TECHNICAL FIELD

The invention relates to the tripping of electrical protection equipment such as circuit breakers, notably in the field of low voltage. More generally, the invention relates to an electromagnetic actuator able to be used as a single tripping device of a cut-off unit.

PRIOR ART

A circuit breaker provides for protecting an electrical line by cutting off the current in the event of a fault, notably upon a short circuit, when the intensity exceeds a high threshold, or in the event of an overload, when the intensity remains within values close to the nominal intensity but over a duration that is too long.

To fulfill both safety criteria, usually and as illustrated in FIG. 1, most low-voltage modular circuit breakers 1 are equipped with two types of tripping device connected to the line to be protected: an electromagnetic actuator 2 separates contacts 4, 6 in the event of a short-circuit, and a bimetal strip type thermal tripping device 8 reacts to overloads: see for example FR 2 682 533. Depending on the range of circuit breaker, the electromagnetic actuator 2 can take various shapes, notably with a solenoid plunger as presented with reference to FIG. 1 or with an armature as described in FR 2 772 981.

The presence of two distinct elements 2, 8 provides for separate control of parameters relating to tripping on the two types of faults. This tried and tested bimetal strip/actuator design however requires sufficient volume in the casing of the circuit breaker 1, and involves a number of sizeable parts to be assembled.

Sometimes consideration is made to removing the need for one of the two elements, for example through the use of a magneto-hydraulic actuator (or dashpot) described in U.S. Pat. No. 2,690,528, or a quick-return bimetal strip system (referred to as a rounded bimetal strip, as described in EP 1 001 444). In addition to the drawbacks inherent to their designs (control difficulties and limitation of cut-off power respectively), these solutions nevertheless retain two operating principles paired together.

SUMMARY OF THE INVENTION

Among other advantages, the invention aims to overcome drawbacks of existing circuit-breaker tripping devices, notably by proposing a new type of the electromagnetic actuator which provides for ensuring tripping on short circuit and overload conditions.

In one of its aspects, the invention thus relates to an electromagnetic actuator which provides for the movement of a contact, secured to it, both when the current exceeds a nominal value over a long duration, and when the current exceeds a threshold on an occasional basis.

The invention notably relates to an electromagnetic actuator in which a magnetic shunt device is fitted at the coil, in series with respect to the magnetic flux path, said shunt device comprising a magnetothermal (or magnetocaloric) material, i.e. a material for which the magnetization increases with temperature above a first temperature greater than or equal to 330 K, and notably exhibits a peak, the maximum of which is greater than 40 emu/g, with a rapid increase in magnetization between 350 and 420 K under a magnetic field of 0.2 to 2 T. The magnetocaloric material is in particular an alloy of nickel and manganese, preferably of the NiCoMnX type, where X is chosen from among aluminum, indium, antimony or tin.

The actuator as such is conventional, with a magnetic circuit comprising a fixed magnetic frame, a coil capable of being connected to an electrical circuit at its ends, and a magnetic element movable with respect to the frame according to the intensity of the current flowing in the coil. Notably, the movable magnetic element can be a solenoid plunger which moves within the coil, the plunger and the coil being housed in the frame. Alternatively, the movable magnetic element can be of the armature type, with a U-shaped frame, at least one of the branches of which is surrounded by the coil, and the armature moving with respect to the branches of the U-shape in order to close it.

The shunt device can extend along the axis of the coil, notably inside for a solenoid plunger actuator. Preferably in the shape of a cylinder, it can be formed entirely of magnetocaloric material or its effects can be dimensioned by adapting the degree of magnetocaloric material within it. The dimensions of the cylinder are themselves also adapted to the force desired for the shunt device with respect to the current flowing in the coil.

The electromagnetic actuator can be fitted in a cut-off unit, notably a modular molded-case circuit breaker, one of the contacts of the cut-off unit being coupled to the movable element of the actuator, in order to open or close the line according to the current flowing in the coil. In particular, the actuator can form a device for tripping such a cut-off unit, the coil then being coupled to the line which the cut-off unit is set up to protect and the movable element able to be coupled to a movable contact of the unit, for example in a rigid manner.

BRIEF DESCRIPTION OF THE DRAWINGS

Other advantages and features will become clearer from the following description of particular embodiments of the invention, which are given by way of illustration and are not at all limiting, and which are represented in the appended drawings.

DETAILED DESCRIPTION OF A PREFERRED EMBODIMENT

The action of the bimetal strip in a tripping system is replaced according to the invention by a saturable magnetic shunt system, which is integrated in a usual electromagnetic actuator, which retains its role of tripping on short circuit. The shunt associated with the actuator thus takes on the function of tripping on overload.

Figure 2:
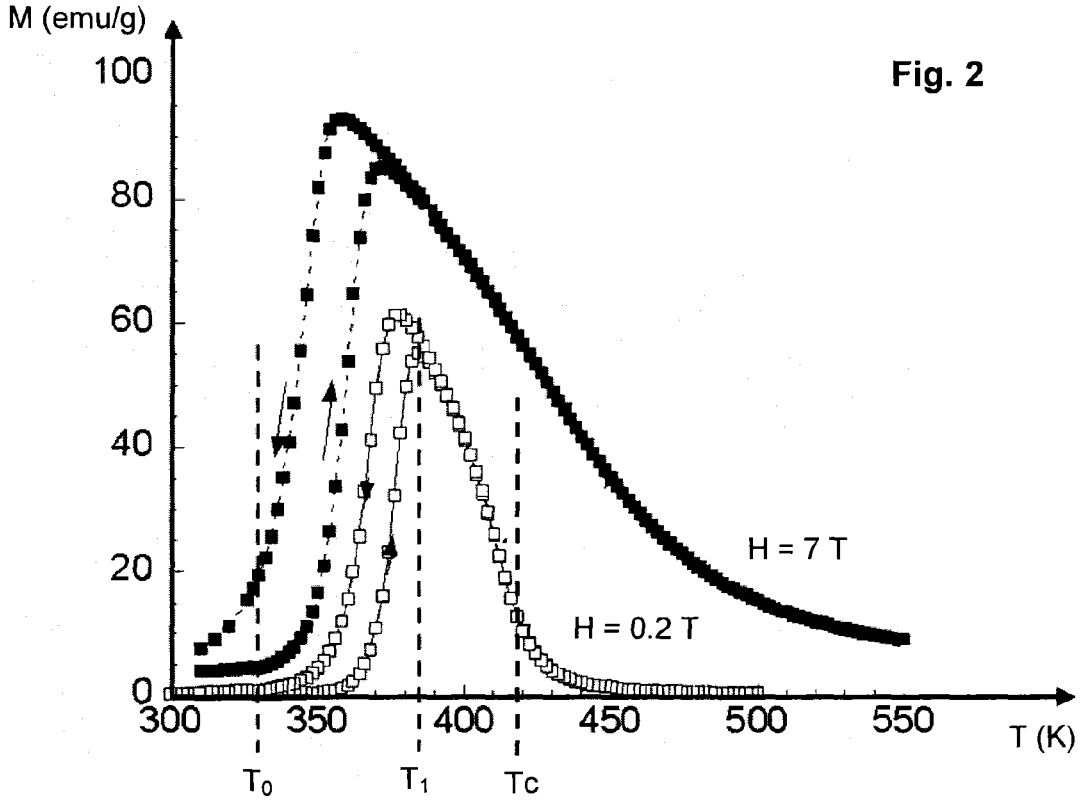
FIG. 2 shows the characteristics of the material which can be used in the shunt of an actuator according to the invention.

To this end, the material of the shunt is chosen for its magnetothermal, or magnetocaloric, properties. More specifically, as illustrated in FIG. 2, the material is such that its degree of magnetization M exhibits a peak dependent on temperature. Notably, at low temperature, the material is not very, or even not at all, magnetic. When the temperature increases, above a first temperature $T_0$, the magnetization M of the material increases rapidly, to reach a maximum at a second temperature $T_1$, above which the magnetization decreases until it is canceled at the Curie temperature Tc of the material. These various temperatures $T_0$, $T_1$, Tc are themselves dependent on the magnetic field H applied (see the variations obtained for a field of 0.2 T and a field of 7 T in FIG. 2).

For a use according to the invention, the first temperature $T_0$ is chosen to be greater than 330 K, preferably close to 350 K. This choice is made possible through the use of materials of the NiCoMnX family, where X∈{Al, In, Sb, Sn}, preferably aluminum or tin. For these materials, the transition is very marked with a temperature $T_1$ close to $T_0$ (difference of 10 to 30 K) and a high magnetization, in the order of 70 emu/g. Notably, for $Ni_{40}Co_{10}Mn_{33}Al_{17}$: $T_0$=347 K, Mmax=90 emu/g.

Figure 3A:
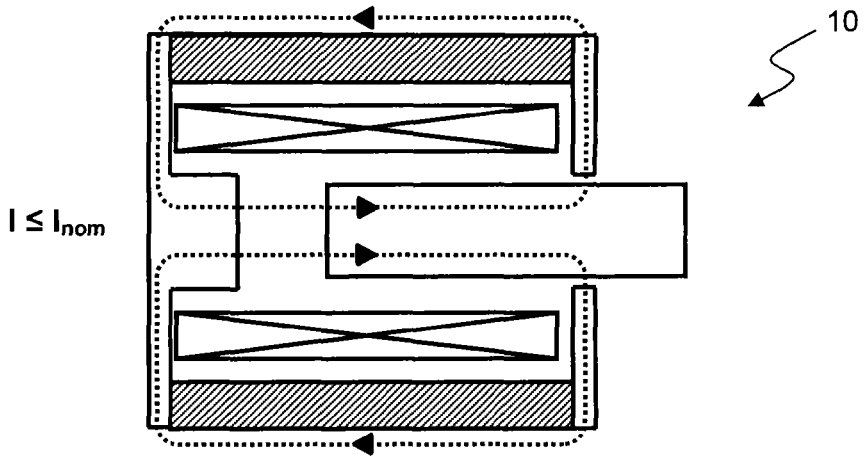
FIGS. 3A-3C represent an actuator according to an embodiment of the invention, with an illustration of the magnetic induction forces according to the current flowing therein.
Figure 3B:
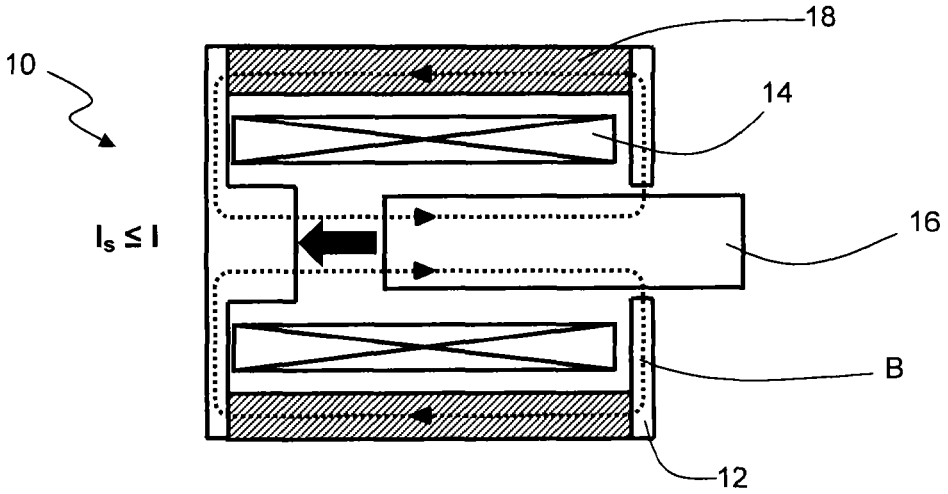
Figure 3C:
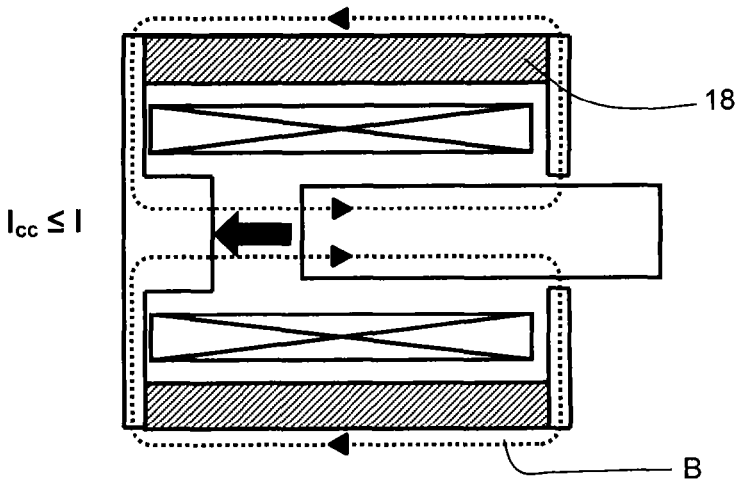

The actuator according to the invention thus comprises a shunt associated with the coil. Notably, as illustrated in FIGS. 3A-3C, an actuator 10 according to the invention comprises a magnetic circuit with a fixed magnetic frame 12 housing a longitudinal coil 14 within which a magnetic solenoid plunger 16 can move. The coil 14 is connected to an electrical supply line and, depending on the current flowing therein, induces a magnetic field B in the magnetic circuit which moves the plunger 16 along the axis of the coil 14.

A device 18 comprising the magnetocaloric material is fitted around the coil 14, within the frame 12, in order to form a magnetic shunt in the magnetic circuit. The shunt device 18 preferably forms a cylinder housed in the frame 12. The shunt can be provided by the device 18 as a whole, hence formed in its entirety of magnetothermal material. Preferably, the shunt device 18 is thus formed by stacked disks, or juxtaposed bars or lamination. Alternatively, the shunt device 18 can comprise a support with which there is associated, or in which there is integrated, some magnetocaloric material, thereby providing for a simplified shape like a cylinder. The shunt device 18 can also form part of the frame 12 to which there are associated, for example inserted in grooves or attached, elements made of appropriate material.

As illustrated in FIG. 3A, when the current I passing through the coil 14 is less than or equal to the nominal current $I_{nom}$, the temperature of the assembly 10 remains not very high, close to the ambient temperature. The temperature of the shunt device 18 remains less than the first temperature $T_0$. Therefore the shunt is in its non-magnetic state and the reluctance of the magnetic circuit is strong, similar to that of the same actuator without a shunt device. The force of the field B induced on the magnetic plunger 16 remains weak and less than the tripping threshold. The plunger 16 therefore remains in its rest position.

When the current I exceeds an overload value $I_s$, the temperature rises within the coil 14. Under the effect of this rise, the temperature at the shunt device 18 increases to be located, at least momentarily, within the magnetization range, between $T_0$ and $T_1$. Therefore the magnetothermal material switches to its magnetic state. As illustrated in FIG. 3B, the shunt device 18 then channels the induced flux B and the reluctance of the circuit reduces. The force on the movable plunger 16 gradually increases, to become greater than the tripping threshold. The movable plunger 16 hence moves, and it can unlock the mechanism of the circuit breaker 1 in order to open the line in which it is placed.

Advantageously, a direct thermal contact is provided between the shunt 18 and the coil 14. In fact, the shunt made of magnetocaloric material sees its magnetic state dependent on the temperature and magnetic field to which it is subjected, which values, for their part, are dependent on the value of the current I flowing in the coiling 14. The dimensioning of the system 10 provides for setting the corresponding value of overload current $I_s$ in order to locate the temperature induced in the range [$T_0$, $T_1$] of non-magnetic/magnetic phase transition of the material, and for dimensioning the field induced by the shunt in order to enable the movement of the plunger 16 and therefore the tripping of a circuit breaker 1 associated with the actuator 10. In particular, it is possible to choose the quantity of material for the shunt, notably via the length and cross-section, or even the composition, of the device 18, as well as the length and cross-section of the turns of the coiling 14.

It is to be noted that if the current I exceeds the value of the short-circuit current $I_{cc}$, it causes a magnetic saturation of the whole circuit, regardless of the state of the magnetothermal material of the shunt 18. Thus enough flux B passes in all cases through the movable plunger 16 to cause its movement and therefore the tripping of the circuit breaker 1 (FIG. 3C).

The shunt device 18 therefore has very little influence on the operation of the actuator 10 in the event of a short circuit. Furthermore, since it is positioned in the leakage flux of the coiling 14, the shunt 18 has very little influence on the force of attraction of the movable plunger 16 under nominal current $I_{nom}$. The actuator 10 can therefore retain the existing design and dimensions according to the operation and cut-off parameters required for its short-circuit cut-off functions, even if the characteristics of the tripping system according to the invention can provide for an optimization.

Figure 1:
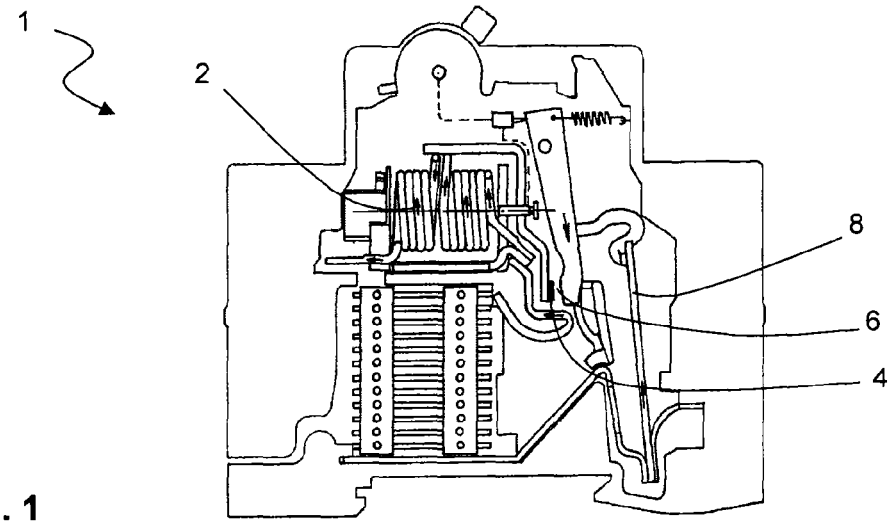
FIG. 1, already described, illustrates a low-voltage molded-case circuit breaker in which the actuator according to the invention can be fitted.

Thus, an actuator 10 according to the invention fitted in a cut-off unit, notably a molded-case and/or modular low-voltage circuit breaker 1 as illustrated in FIG. 1, provides for carrying out the two protection functions through a single component, purely magnetically and without the need to heat a bimetal strip. Volume is therefore freed up by the absence of the bimetal strip, which volume becomes available within the casing for new features. The overall thermal dissipation of the unit 1, 10 is also restricted, thereby increasing its reliability and its energy efficiency. Lastly, the absence of thermal control provides for a reduction in manufacturing costs, as a reduction in the number of parts to be assembled.

Although the invention has been described with reference to an electromagnetic actuator 10 with a movable plunger 16, it is not limited thereto. Other elements can be involved through the fitting of such a magnetothermal shunt, in order to replace magnetic and thermal tripping devices of existing circuit breakers. In particular, the use of a saturable magnetic shunt system, the purpose of which is to channel a more or less large part of the flux according to the current flowing in the product, can be adapted for an armature-based electromagnetic actuator, notably for use in a cut-off unit.

Figure 4:
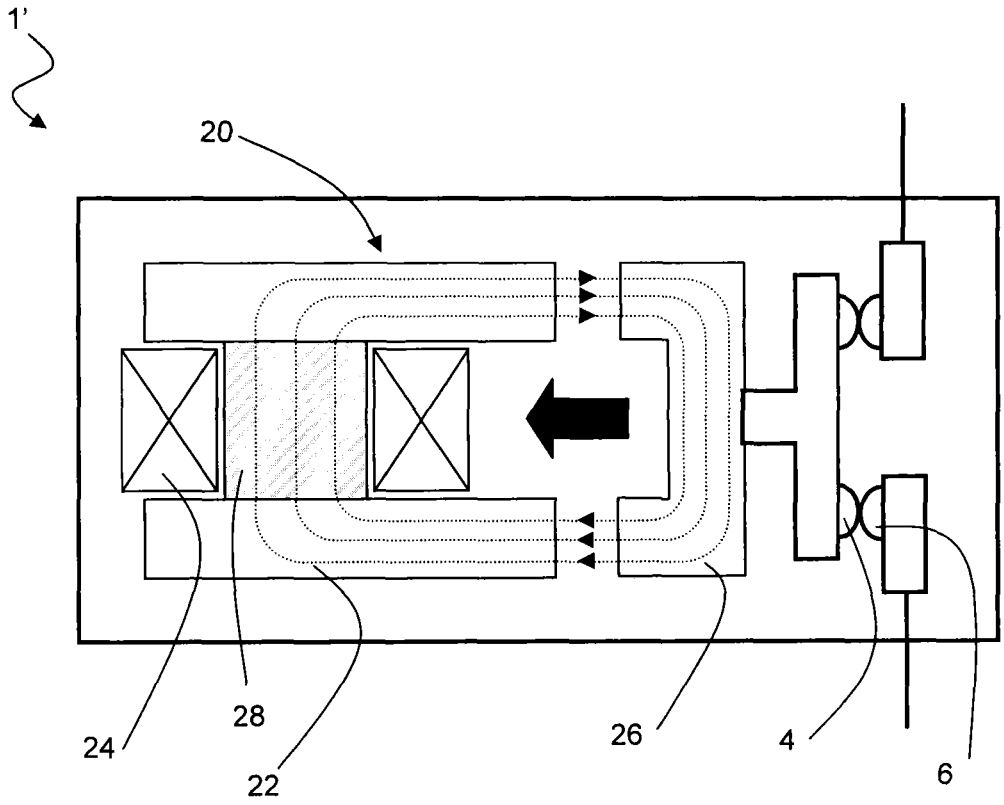
FIG. 4 shows another embodiment of a circuit breaker according to the invention.

Thus, as illustrated in FIG. 4, the cut-off unit 1' comprises two contacts 4, 6 movable relative to one another, at least one of the two contacts being associated with the movable part of an electromagnetic actuator 20, the magnetic circuit of which comprises:

- a fixed magnetic frame 22, of substantially U-shape;
- a coil 24 connected to the current-carrying line by its ends and surrounding at least one branch of the magnetic U-shape 22;
- an armature 26 movable relative to the frame 22 according to the current flowing in the coil 24, between a position of rest in which a gap exists between the U-shape 22 and the armature 26, and a cut-off position in which the armature 26 closes said U-shape 22;

a shunt device 28 of magnetothermal material installed within the coil 24, more generally along the axis of the coiling 24.

Here again, the heating of the shunt 28 is produced by thermal contact with the coiling 24 with the current flowing through it and/or by the Joule effect by making all or some of the current flow in the active material. The two functions of the circuit breaker 1' are thus provided by a single tripping and actuating device 20, more effectively from a technical, economical, environmental and manufacturing perspective.

The invention claimed is:

1. An electromagnetic actuator comprising:

a magnetic circuit with a fixed magnetic frame;

a coil configured to be connected to an electrical circuit at its ends;

a magnetic element movable with respect to the frame according to intensity of current flowing in the coil;

a shunt device extending along the axis of the coil, the shunt device comprising a magnetocaloric material for which magnetization increases with temperature above a first temperature greater than or equal to 330 K and reaches a maximum at a second temperature of less than 420 K, the magnetization maximum being greater than 40 emu/g.

2. The actuator as claimed in claim 1, wherein the magnetocaloric material is an alloy of nickel and manganese.

3. The actuator as claimed in claim 2, wherein the magnetocaloric material is of the NiCoMnX type, where $X \in \{Al, In, Sb, Sn\}$.

4. The actuator as claimed in claim 1, wherein the movable magnetic element includes a solenoid plunger housed in the coil within which it moves, the plunger/coil assembly being housed in the frame.

5. The actuator as claimed in claim 1, wherein the shunt device forms a cylinder around the coil.

6. The actuator as claimed in claim 1, wherein the magnetic element is an armature, the frame forming a U-shape, at least one of branches of which is surrounded by the coil, the armature moving with respect to the frame to close the U-shape.

7. A cut-off unit comprising a pair of contacts movable with respect to one another and an actuator as claimed in claim 1, at least one of the contacts being coupled to the movable element of the actuator.

8. A circuit breaker tripping device comprising an actuator as claimed in claim 1, the movable element and the coil of the actuator configured to be coupled to a current-carrying line to be protected.

9. A modular circuit breaker comprising a casing housing a tripping device as claimed in claim 8 and a pair of contacts movable with respect to one another, a first contact being coupled to the movable element of the actuator.

* * * * *